US007144417B2

(12) United States Patent
Colloca et al.

(10) Patent No.: US 7,144,417 B2
(45) Date of Patent: Dec. 5, 2006

(54) ELECTROMECHANICAL ADJUSTING INSTRUMENT

(76) Inventors: Christopher J. Colloca, 11011 S. 48th St., Suite 220, Phoenix, AZ (US) 85044; Tony S. Keller, 99 Nottingham La., Burlington, VT (US) 05401

( * ) Notice: Subject to any disclaimer, the term of this patent is extended or adjusted under 35 U.S.C. 154(b) by 0 days.

(21) Appl. No.: 11/162,067

(22) Filed: Aug. 26, 2005

(65) Prior Publication Data

US 2006/0047315 A1 Mar. 2, 2006

Related U.S. Application Data

(60) Provisional application No. 60/604,787, filed on Aug. 26, 2004, provisional application No. 60/604,738, filed on Aug. 26, 2004.

(51) Int. Cl.
*A61H 23/02* (2006.01)
*A61H 1/00* (2006.01)

(52) U.S. Cl. ..... 606/239; 601/108; 601/111

(58) Field of Classification Search ..... 601/80, 601/101, 103, 107, 108, 110, 111; 606/237, 606/238, 239

See application file for complete search history.

(56) References Cited

U.S. PATENT DOCUMENTS 4,549,535 A * 10/1985 Wing ..... 601/108
4,841,955 A * 6/1989 Evans et al. ..... 601/101
6,228,042 B1 * 5/2001 Dungan ..... 601/107
6,537,236 B1 * 3/2003 Tucek et al. ..... 606/239
6,663,657 B1 * 12/2003 Miller ..... 606/239

* cited by examiner

*Primary Examiner*—Quang D. Thanh
(74) *Attorney, Agent, or Firm*—Venable, Campillo, Logan & Meaney PC

(57) ABSTRACT

A chiropractic adjusting instrument comprising a housing; a thrust nose piece and an impact head to contact a body; a preload switch plunger; a dampening spring; a solenoid having a core; a preload spring; a recoil spring; an electronic pulse system operatively connected to a power source to provide alternating current for energizing the solenoid to impart impulse energy from the core to the thrust nose piece which is reproducible and independent of the power source; and a trigger system for triggering the electronic pulse system comprising an switch activated by the preload switch plunger. Preferably, the chiropractic adjusting instrument includes one or more of the following: an intelligent universal AC power converter; optimized force-time waveform; pulse mode operation; and a suite of electromechanical components designed to promote reproducible dynamic force impulses and safe operation.

32 Claims, 9 Drawing Sheets

ELECTROMECHANICAL ADJUSTING INSTRUMENT

This application claims the benefit of U.S. Provisional Patent Applications: 60/604,787 filed on Aug. 26, 2004 and 60/604,738 filed on Aug. 26, 2004.

FIELD OF THE INVENTION

The present invention relates to the field of adjusting instruments and methods. Particularly, it involves the field of electromechanical manipulation/adjusting instruments used to apply controlled dynamic forces to the human body. More particularly, the invention has an improved force-time waveform and pulse mode.

BACKGROUND

It is well known in the chiropractic art that humans may suffer from musculoskeletal pain. Misalignment or other mis-adjusment or subluxation of the spine and bones of the human body can lead to musculoskeletal discomfort and a variety of related symptoms. Adjustment of the spine to a healthy alignment may have substantial therapeutic effects.

There is a need to create electromechanical adjusting instruments that apply a controlled and reproducible impulse energy regardless of the power source or voltage fluctuation; to create electromechanical adjusting instruments that have a waveform tuned to the nature of the body to allow more bone movement and broader neural receptor stimulation with less force; and to have an interlock so that the device cannot be triggered unless the appropriate preload is attained. There is also a need to use the electric impulses applied to the solenoid to calibrate the instrument and to diagnose the electric impulses applied to the solenoid; to select pre-determined force settings quickly and easily; to be notified of the proper application of preload prior to thrusting; to administer single or multiple thrusts by means of the device trigger; to provide a thrust nose piece to accept interchangeable impact heads; and to reduce vibrations to the operator to reduce stress and provide comfort.

Information relevant to hand held devices can be found in U.S. patent and Patent Publication Nos. Pat Nos. 4,116,235; 4,498,464; 4,682,490; 4,716,890; 4,841,955; 4,984,127; 5,085,207; 5,618,315; 5,626,615; 5,656,017; 5,662,122; 5,897,510; 6,165,145; 6,379,375; 6,503,211; 6,792,801; 6,537,236; 6,539,328; 6,602,211; 6,663,657; 6,682,496; 6,702,836; 6,805,700; and 20020082532; 20020177795; 200300114079; 20050131461; each of the foregoing in United States patent and Patent Publication Nos. is hereby incorporated herein by reference. Each one of these referenced items, however, suffers from disadvantages including; for example, one or more of the following.

One disadvantage is that they are not able to use more than one electric power source to provide reproducible impulse energy to the body.

Another disadvantage is that they do not have trigger system and pulse system including an interlock such that the device cannot be activated with an appropriate preload.

Another disadvantage is that they do not have a way to use the electric impulses applied to the solenoid to calibrate the instrument and to diagnose the electric impulses applied to the solenoid.

Another disadvantage is that they do not have an interlock so that the device cannot be triggered unless the appropriate preload is attained.

Another disadvantage is that they do not create electromechanical adjusting instruments that have a waveform specifically tuned to the nature of the body to allow more bone movement and more neural receptor stimulation with less force.

Another disadvantage is that they do not provide a thrust nose piece to accept interchangeable impact heads or reduce vibrations to the operator to provide comfort.

Another disadvantage is that they do not have a preload indication system.

SUMMARY

It is an object of the present invention to provide a chiropractic adjusting instrument comprising a housing having an opening; a thrust nose piece movably mounted in the housing and comprising a preload side and an outer end including an outer end shank for coupling to at least one impact head wherein the opening allows the coupled outer end shank impact head to contact a body; a preload switch plunger coupled to the preload end of the thrust nose piece; a dampening spring interposed between the housing and the outer end of the thrust nose piece or a first inner housing stop having a first passage to accept the thrust nose piece; a solenoid mounted in the housing and comprising: a longitudinal axis and a core having a third passage to accept the preload switch plunger so that the core is movable along the longitudinal axis and is in alignment with the thrust nose piece; a preload spring interposed between the preload side of the thrust nose piece and a second inner housing stop having a second passage sufficient to accept the coupled preload switch plunger preload side; a recoil spring interposed between the core and the coupled preload switch plunger preload end; a third inner stop to prevent the normal urging of core away from the coupled preload switch plunger preload end and having a fourth inner passage to accept the preload switch plunger; a pulse system operatively connected to a power source to provide alternating current for energizing the solenoid to impart impulse energy from the core to the thrust nose piece which is reproducible independent of the power source; a trigger system for triggering the pulse system comprising an switch activated by the preload switch plunger.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

Figure 1:
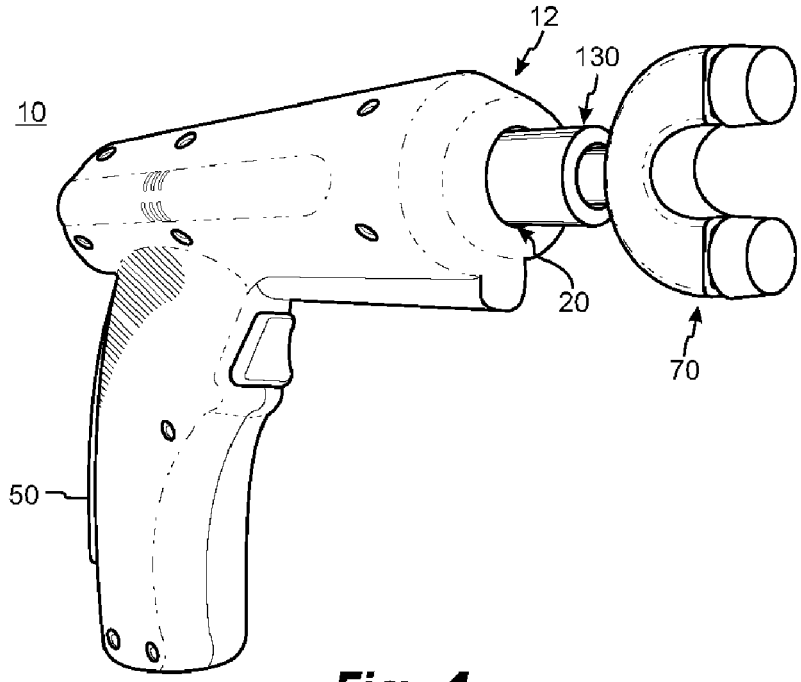
FIG. 1 is a side view of a preferred embodiment of the invention with one embodiment of an impact head depicted.
Figure 2:
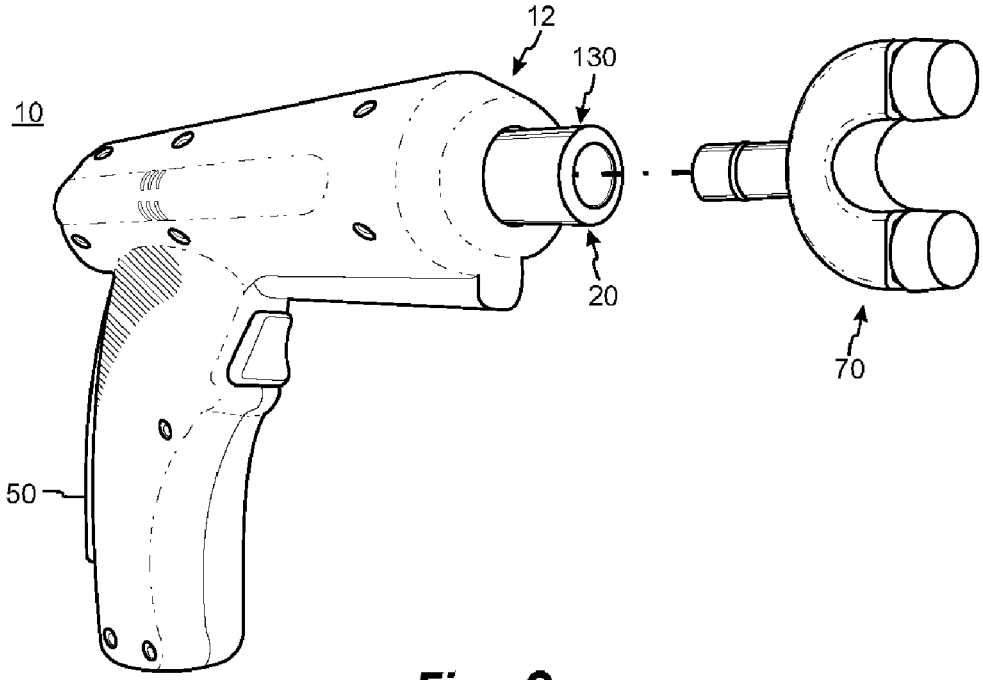
FIG. 2 is a side exploded view of a preferred embodiment of the invention with one embodiment of an impact head depicted.
Figure 3:
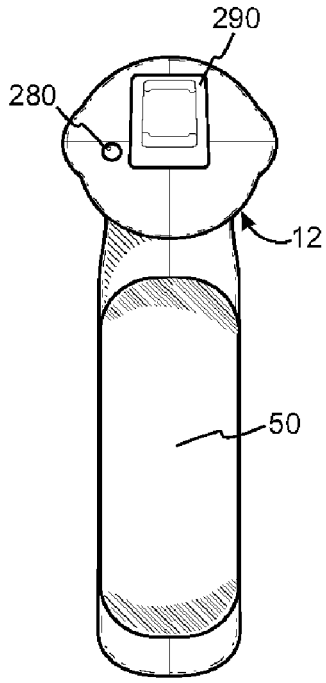
FIG. 3 is a first end view of the preferred embodiment of the invention.
Figure 4:
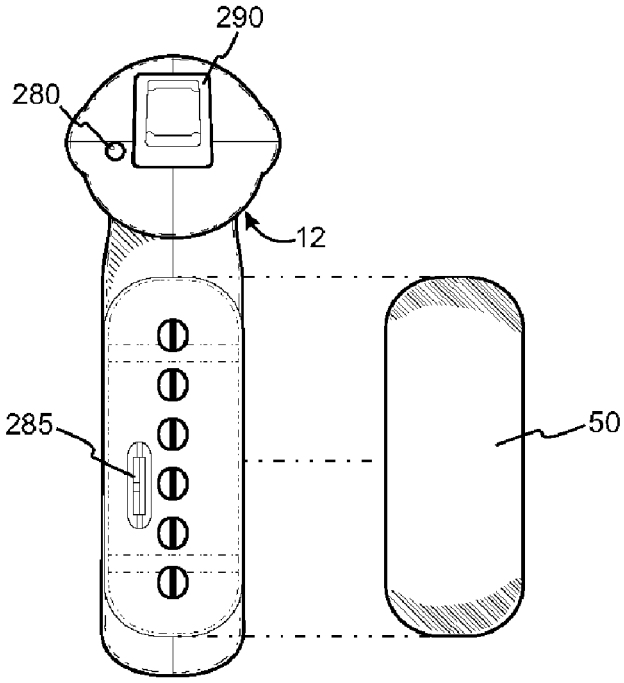
FIG. 4 is a first end exploded view of the preferred embodiment of the invention.
Figure 5:
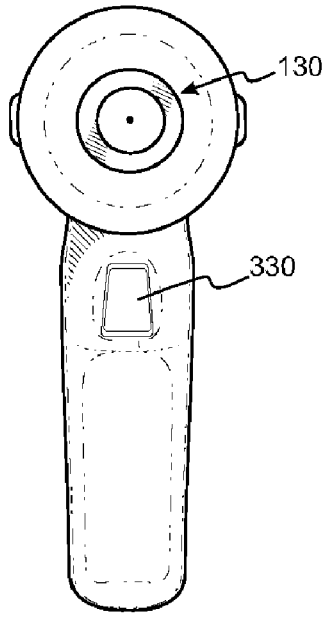
FIG. 5 is a second end view of the preferred embodiment of the invention.
Figure 6:
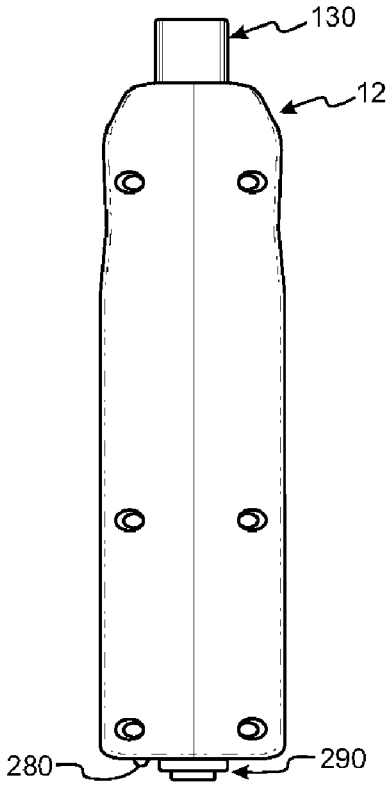
FIG. 6 is a top view of the preferred embodiment of the invention.

Referring to the FIGS. 1–13 and 14A–D, there are depicted a preferred embodiments of the chiropractic adjusting instrument invention and its components. The preferred embodiment of the invention, generally referenced by 10, are depicted in FIGS. 1–6 and include a housing 12 that, in this preferred embodiment, is gun shaped having an alternating current power cord 40 and a shock absorbing grip 50. The chiropractic adjusting instrument 10 further includes an electromechanical drive mechanism 100, an electronic pulse system 200 and a trigger system.

In the preferred embodiment, the housing 12 of the chiropractic adjusting instrument 10 has an opening 20 and an inside cavity 30 for mounting the electromechanical drive mechanism 100. Preferably, the housing is made of a non-conductive material such as plastic. As shown in preferred embodiment of FIG. 7, the inside cavity consists of a housing inside 102, a first inner housing stop 105, a second inner housing stop 110 and a third inner housing stop 115 and an interior cavity to place the electromechanical drive mechanism within the housing 10.

Figure 11:
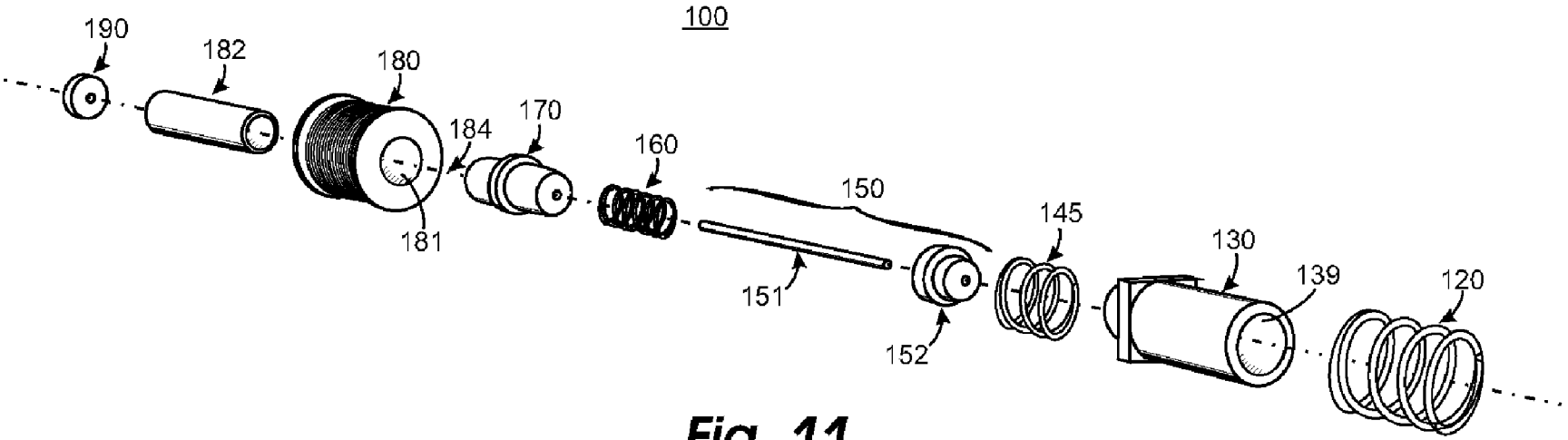
FIG. 11 is an exploded view of the preferred embodiment of the electromechanical drive mechanism without the housing.

FIGS. 7–11 show numerous views a preferred embodiment of the components of the electromechanical drive mechanism 100. Specifically, FIG. 11 shows a dampening spring 120, a thrust nose piece 130, a preload spring 145, a preload switch plunger 150 (comprising a plunger rod 151 and an plunger cap 152), a recoil spring 160, a coupler 170, a solenoid 180 having a core 185 and a shock absorber 190. In this preferred embodiment, the thrust nose piece 130 is adapted to be movably mounted in the housing 12 and includes an outer end 136, an outer end shank 138 adapted to couple to at least one impact head 70, and a preload side 131 adapted to couple to the preload switch plunger 145. In a more preferred embodiment, the thrust nose piece 130 further comprises a preload shank 133 and a preload end 134 having a cavity 135 adapted to the plunger cap 151 and a bore 139 adapted to the at least one impact head 70. In more preferable embodiment, the outer end shank 138 extends through the opening 20. The thrust nose piece 130 may be made of metals, such as steel, or other hard materials.

Figure 7:
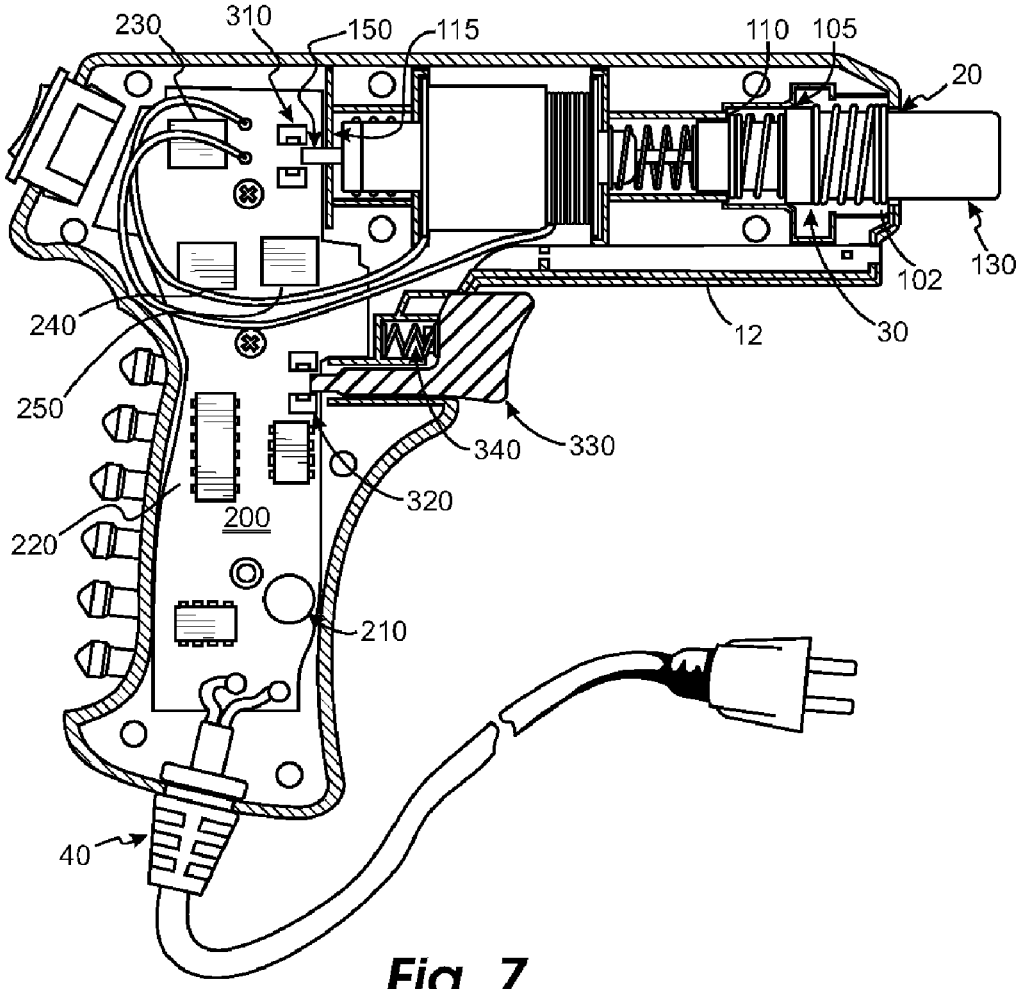
FIG. 7 is a cross-sectional view of the preferred embodiment of the invention.
Figure 12:
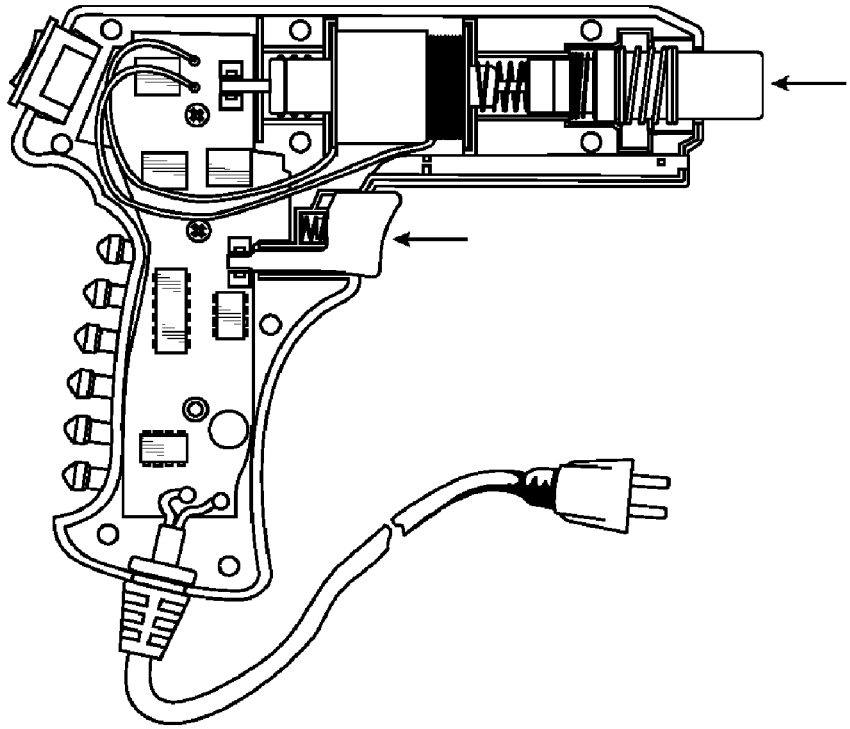
FIG. 12 is a cross-sectional view of the preferred embodiment of the invention with the arrows showing the direction of movement along the thrust nose piece direction and the trigger direction.
Figure 13:
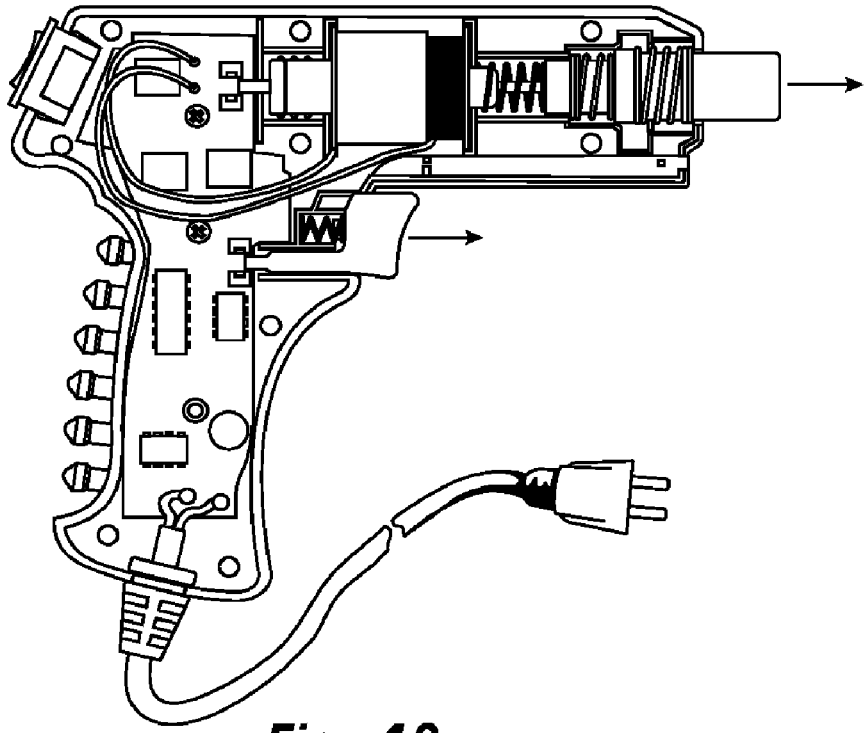
FIG. 13 is a cross-sectional view of the preferred embodiment of the invention with the arrows showing the direction of movement along the thrust nose piece direction and the trigger direction when returning to rest.
Figure 14:
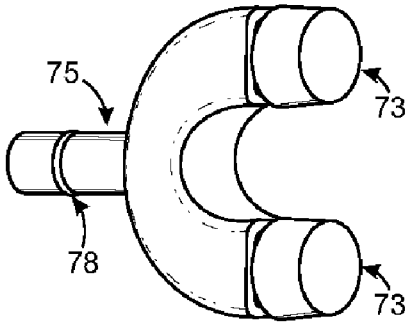
FIGS. 14A–D are views of three preferred embodiments of the impact heads.
Figure 14A:
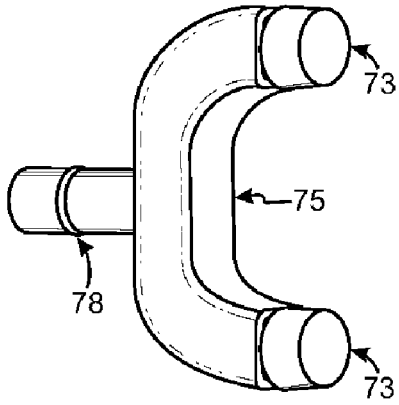
Figure 14B:
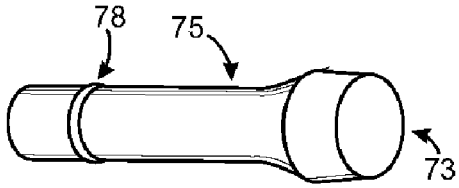
Figure 14C:
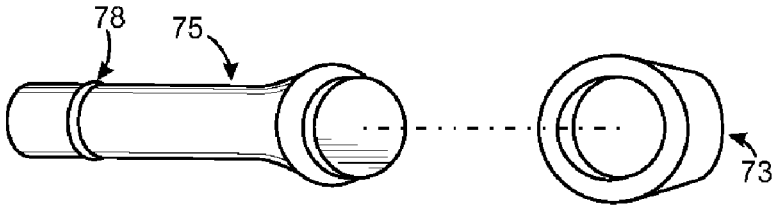
Figure 14D:
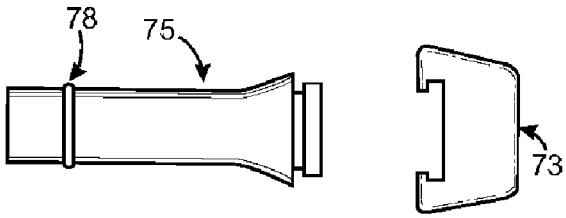

In the preferred embodiments shown in FIGS. 7 and 11, the dampening spring is adapted to be mounted in the housing and interposed between the housing inside 102 and the first inner housing stop 105 or the outer end 136 of the thrust nose piece 130 depending on the position of the thrust nose piece 130 (see FIGS. 12 and 13). In a more preferred embodiment as shown, the dampening spring is made of metal, such as steel, or other material having sufficient spring force.

In the preferred embodiments shown in FIGS. 7 and 11, the preload spring 145 is interposed between the second inner housing stop 110 and the preload side 131 of the thrust nose piece 130. In a more preferred embodiment as shown, the preload spring is made of metal, such as steel, or other material having sufficient spring force.

In the preferred embodiments shown in FIGS. 7 and 11, the preload switch plunger 150 couples to thrust nose piece 130. In one embodiment the preload switch plunger 150 may be integral with the thrust nose piece 130. In another embodiment, the preload switch plunger 150 is a single piece and may couple with the thrust nose piece 130; more preferably coupling with the preload end 134. In yet another preferred embodiment, as shown in FIG. 11, the preload switch plunger 150 comprises a plunger rod 151 and a plunger cap 152. The preload switch plunger 150 may be made of metal or plastic or combinations thereof. Preferably, the preload switch plunger 150 is not conductive to the thrust nose piece 130. In the preferred embodiment shown in FIG. 12, when the thrust nose piece has compressed the preload spring sufficiently to the preload position, the preload switch plunger extends to close switch 310 and activate switch 330.

As depicted in the preferred embodiments of FIGS. 7, 8, 9 and 11, the solenoid 180 has a core opening 181 and a core 182 that is movable and a longitudinal axis 184. The solenoid 180 is mounted inside the housing 12 in a stationary position such that the core 182 is movable along the longitudinal axis 184 and is in alignment with the thrust nose piece 130. Further, the core has a third passage 186 transversing the entire length of the core 182 to accept the preload switch plunger 150. The core 182 is made of material that is electromagnetically coupled to the solenoid 180 when the solenoid 180 is energized by a current.

Figure 8:
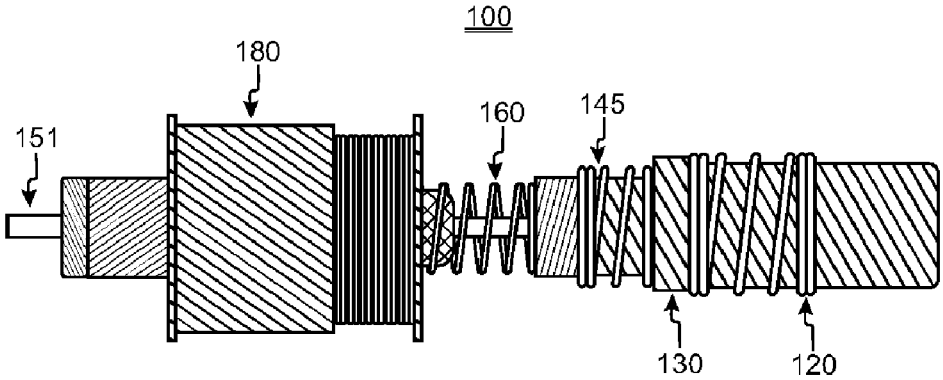
FIG. 8 is a view of the preferred embodiment of the electromechanical drive mechanism without the housing.
Figure 9:
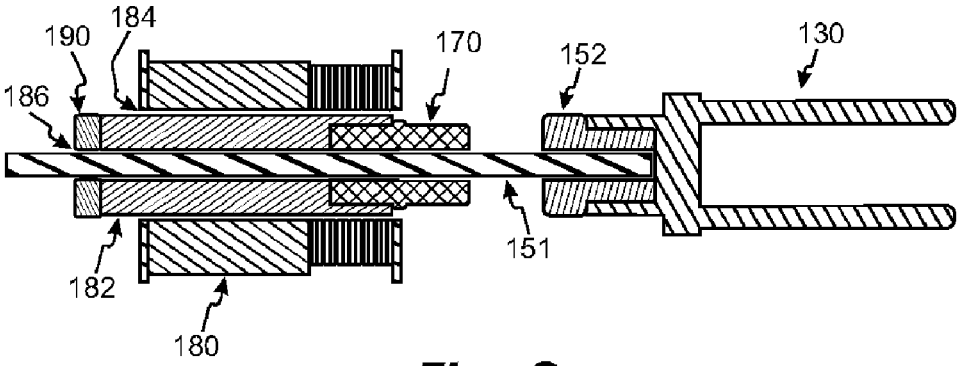
FIG. 9 is a cross-sectional view of the preferred embodiment of the electromechanical drive mechanism without the housing and related springs.
Figure 10:
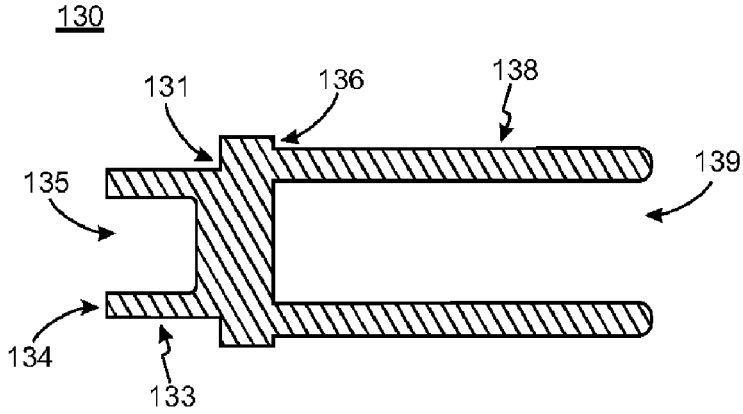
FIG. 10 is a cross-sectional view of the preferred embodiment of a thrust nose piece.

As depicted in the preferred embodiments of FIGS. 7, 8 and 11, the recoil spring 160 is interposed between the core 182 and the coupled preload switch plunger preload end and is chosen to reduce the backward forces generated and to place the core in the proper position when the chiropractic adjusting instrument 10 is at rest. In a more preferred embodiment as shown, the recoil spring is made of metal, such as steel, or other material having sufficient spring force. As shown in FIGS. 7, 9 and 11, a preferred embodiment of the chiropractic adjusting instrument 10 includes a coupler 170 between the core 182 and the recoil spring 160. Further, in the more preferred embodiment the coupler 170 is made of a nonconductive material such as plastic and most preferably nylon or TEFLON. In the preferred embodiment shown in FIGS. 7, 9 and 11, the recoil spring is interposed between the coupler 170 and the preload switch plunger 150.

As shown in FIG. 7, the housing 12 includes a first inner housing stop 105 having a first passage to accept the thrust nose piece 130, a second inner housing stop 110 having a second passage sufficient to accept the coupled preload switch plunger preload end, and a third inner stop 115 having a fourth inner passage to accept the preload plunger 150.

In a preferred embodiment, the chiropractic adjusting instrument 10 also includes a shock absorber 190 having a shock absorber passage 192 between the core 182 and the third inner stop 115. The shock absorber 190 is made of an energy absorbing material such as rubber.

Figure 15:
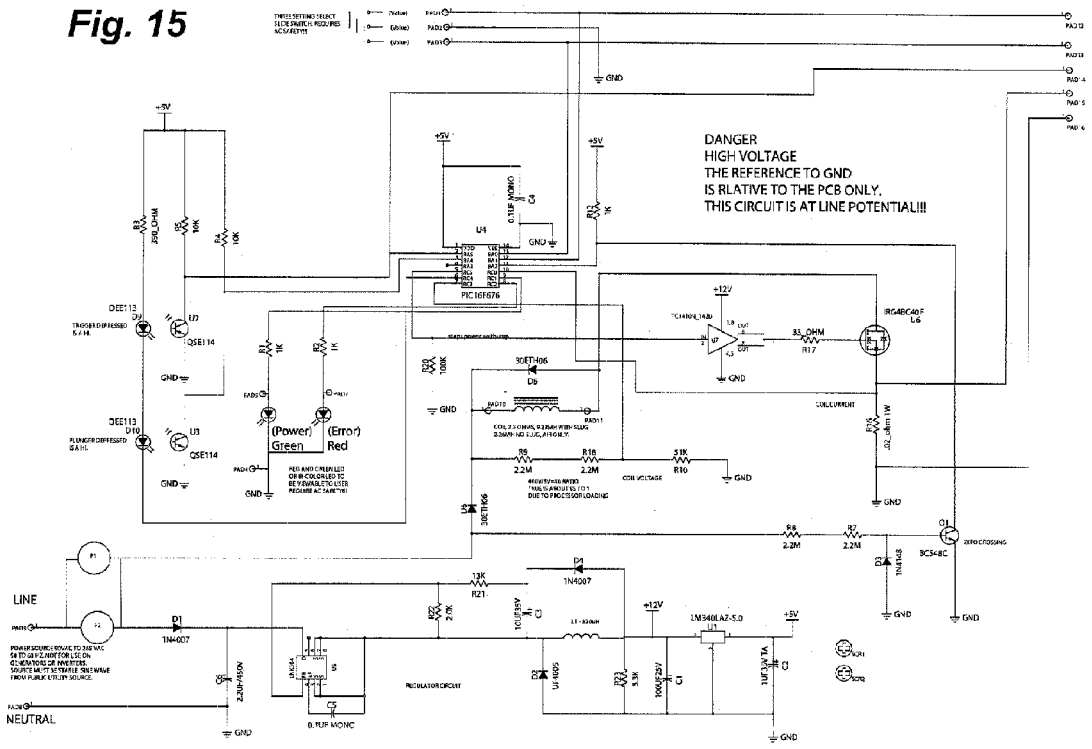
FIG. 15 is a schematic view of one preferred embodiment of a circuit for an electronic pulse system.

The chiropractic adjusting instrument 10 also includes an electronic pulse system 200 operatively connected to an electrical power source to provide alternating current for energizing the solenoid 180 to impart impulse energy from the core to thrust nose piece 130 that is reproducible independent of the power source. An example of one preferred embodiment of a circuit for an electronic pulse system is shown in FIG. 15. In the preferred embodiment of the invention, the pulse system 200 includes at least a transformer 210, a programmable microprocessor 220, a field effect transistor 230 and two high voltage switches 240 and 250 to turn the solenoid on and off. In the preferred embodiment of the invention, the chiropractic adjusting instrument 10 can use any alternating current electric power source having a voltage between 90 and 265 volts and a frequency between 50 and 60 hertz. Specifically, the transformer 220 converts part of the alternating current electricity into direct current electricity to power the pulse circuitry including the programmable microprocessor 220. The programmable microprocessor 220 then diagnoses/analyzes the voltage and the frequency to control the on-off duration of the high voltage switch or switches (duration of the pulse to the solenoid) to energize the solenoid reproducibly so that a pulse system produces constant pulse duration or impulse, and more preferably an impulse that is substantially a half sine wave, and more preferably of between 2 to 5 milliseconds pulse width. Further, the programmable microprocessor 220 preferably may diagnose the device status; for example, whether or not preload is achieved. Table 1, below, lists one preferred operation of the programmable microprocessor 220 control of the chiropractic adjusting instrument:

TABLE 1

1. After power is turned on, a red LED is energized to indicate power to the chiropractic adjusting instrument.
2. The preload switch is activated by depression of the preload switch plunger causing the red LED to be de-energized and a green LED to be energized to indicate that the chiropractic adjusting instrument is armed and successful preload has been achieved.

TABLE 1-continued

3. Activating the trigger switch using the trigger causes both the red and green LED to de-energize and causes the microprocessor the measure the line frequency and voltage, preferably twice.
4. If the line voltage or frequency are outside the test limits, the red LED is energized to flash and the chiropractic adjusting instrument will not fire until the voltage and frequency are retested and fall within the test limits.
5. If the line voltage and frequency are within the test limits, the duration of the pulse to the solenoid is calculated by an equation or determined by one or more look-up tables and the green LED is energized to flash and the chiropractic adjusting instrument fires once or multiple times as selected. In the preferred embodiment, the duration of the pulse to the solenoid will be determined to produce a pulse duration and preferably the same amount of energy will be imparted for each user specified setting (e.g. the velocity of a solenoid core can be varied by varying the force with which it is accelerated into the solenoid which is proportional to the current flowing into the coils of the solenoid which can be controlled by the duration of the pulse to the solenoid).

In a more preferred embodiment, the pulse system 200 includes a level switch 290 having at least two positions for controlling the pulse duration and mode of single or multiple pulses. In another more preferred embodiment shown in FIG. 4, the pulse system 200 includes an access port 285 which for testing, evaluation, downloading of data and programming of the pulse system 200 including the programmable microprocessor 220; more preferably, the pulse system 200 would also include additional memory storage devices for collection of pulse data. In another more preferred embodiment, the pulse system includes an indicator 270 to provide power-on indication, preload ready indication, and error indication; most preferably the indicator is selected from sound indicators and visual indicators such as speakers, light emitting diodes or other auditory output devices or visual output devices. In a most preferred embodiment shown in FIGS. 3 and 4, the indicator is at least one light emitting diode which indicates power, appropriate preload and pulse mode, and error modes using combinations of blinks and colors, such as red and green.

In the preferred embodiment showing in FIG. 7, the chiropractic adjusting instrument 10 also includes a triggering system for triggering the pulse system 200. In this preferred embodiment, the trigger system includes a switch 310 activated by the preload switch plunger 150. The switch acts as an interlock or safety device such that pulse system 200 can not be activated unless the switch 310 activated. The switch 310 can be any type of optical, electrical, mechanical or magnetic switch and may be configured in many ways such that it is coupled to the electromechanical drive mechanism to prevent firing unless activated. In the preferred embodiment shown in FIG. 7, the switch is an optical switch such that the preload switch breaks the optical beam. In the preferred embodiment, the triggering system also includes a trigger switch 320, a trigger 330 and a trigger spring 340 so the operator can activate the trigger switch 320 causing the electronic pulse system 200 to fire. The trigger switch 320 can be any type of optical, electrical, mechanical or magnetic switch, but in the preferred embodiment shown in FIG. 7, the switch is an optical switch such that the trigger breaks the optical beam.

In the preferred embodiment shown in FIG. 12, there is a preload activation position such electromechanical drive mechanism 100 is compressed or preloaded (by placing the impact head on a body or surface, not shown) so that the switch 310 is activated such that chiropractic adjusting instrument 10 may be fired by depressing the trigger 330.

FIG. 13, shows the movement of the electromechanical drive system 100 and the trigger 330 to the rest (or initial position).

The preferred embodiments shown in FIGS. 14 and 14A–D show various preferred embodiments of the impact head 70 including a cushion(s) 73, an impact body 75 and an impact coupler 78. In these preferred embodiments, the cushions are of some soft material such as rubber, the impact body is made of metal such as aluminum, and the impact coupler is typically a soft material such as an o-ring to form a press fit with the thrust nose piece 130.

Alternative preferred embodiments of this invention are contemplated; for example, the use of conventional or rechargeable batteries to power electromechanical drive mechanism 100. More preferably the batteries are removable for changing or recharging.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A chiropractic adjusting instrument comprising:

a housing having an opening; a thrust nose piece movably mounted in the housing and comprising a preload side and an outer end including an outer end shank for coupling to at least one impact head wherein the opening allows the coupled outer end shank impact head to contact a body; a preload switch plunger coupled to a preload end of the thrust nose piece; a dampening spring interposed between the housing and the outer end of the thrust nose piece or a first inner housing stop having a first passage to accept the thrust nose piece; a solenoid mounted in the housing and comprising: a longitudinal axis and a core having a third passage to accept the preload switch plunger so that the core is movable along the longitudinal axis and is in alignment with the thrust nose piece; a preload spring interposed between the preload side of the thrust nose piece and a second inner housing stop having a second passage sufficient to accept the coupled preload switch plunger preload end; a recoil spring interposed between the core and the coupled preload switch plunger preload end; a third inner stop to prevent the normal urging of core away from the coupled preload switch plunger preload end and having a fourth inner passage to accept the preload switch plunger; an electronic pulse system operatively connected to a power source to provide alternating current for energizing the solenoid to impart impulse energy from the core to the thrust nose piece that is reproducible independent of the power source; a trigger system for triggering the electronic pulse system comprising a switch activated by the preload switch plunger.

2. The chiropractic adjusting instrument as recited in claim 1 further comprising a shock absorber having a shock absorber passage between the core and the third inner stop.

3. The chiropractic adjusting instrument as recited in claim 1 further comprising a coupler having a coupler inner passage to accept the preload switch plunger and interposed between the recoil spring and the preload switch plunger, and wherein the core further comprises a coupler end adapted to couple with the coupler.

4. The chiropractic adjusting instrument as recited in claim 3 wherein the coupler is made of nonconductive material.

5. The chiropractic adjusting instrument as recited in claim 4 wherein the nonconductive material is selected from the group consisting of nylon and TEFLON.

6. The chiropractic adjusting instrument as recited in claim 1 wherein the thrust nose piece further comprises a preload shank having the preload end adapted to couple with the preload switch plunger.

7. The chiropractic adjusting instrument as recited in claim 1 wherein preload switch plunger made of materials selected from the groups consisting of metals, nonconductive plastics and combinations thereof.

8. The chiropractic adjusting instrument as recited in claim 1 wherein the housing is gun shaped.

9. The chiropractic adjusting instrument as recited in claim 1 wherein the power source is a single phase alternating current electricity having a voltage between 90 and 265 volts and a frequency between 50 and 60 hertz.

10. The chiropractic adjusting instrument as recited in claim 9 wherein the electronic pulse system comprises a transformer to convert part of the alternating current electricity to direct current electricity to power the pulse circuitry, a programmable microprocessor to diagnose the voltage and frequency of alternating current electricity and control at least two alternating current high voltage switches so that a reproducible measured electric impulse is provided to the solenoid regardless of the alternating current electricity.

11. The chiropractic adjusting instrument as recited in claim 1 wherein the switch is selected from the group consisting of optical, electric, mechanical, magnetic switches and combinations thereof.

12. The chiropractic adjusting instrument as recited in claim 11 further comprising a trigger to activate a trigger switch wherein the trigger switch is selected from the group consisting of optical, electric, mechanical, magnetic switches and combinations thereof.

13. The chiropractic adjusting instrument as recited in claim 1 further comprising an indicator to provide power-on indication, preload ready indication, and error indication.

14. The chiropractic adjusting instrument as recited in claim 13 wherein the indicator is selected from the group consisting of visual indicators or sound indicators.

15. The chiropractic adjusting instrument as recited in claim 14 wherein the indicator is at least one light emitting diode.

16. The chiropractic adjusting instrument as recited in claim 15 wherein the at least one light emitting diode indicates power, appropriate preload and pulse mode, and error modes using combinations selected from the group consisting of at least one color, at least one blink and combinations thereof.

17. The chiropractic adjusting instrument as recited in claim 1 wherein the at least one impact head is selected from group consisting of a single contact head, a dual contact cervical head, and a dual thoracic lumbar head.

18. The chiropractic adjusting instrument as recited in claim 1 wherein the electronic pulse system produces a measured impulse having constant pulse duration.

19. The chiropractic adjusting instrument as recited in claim 18 wherein the measured impulse is substantially a half sine wave.

20. The chiropractic adjusting instrument as recited in claim 1 further comprising a level switch having at least two positions to discretely change preprogrammed imparted impulse energy or pulse mode.

21. The chiropractic adjusting instrument as recited in claim 1 further comprising a shock absorbing grip.

22. The chiropractic adjusting instrument as recited in claim 1 further comprising an access port for testing, evaluation and programming of the electronic pulse system.

23. The chiropractic adjusting instrument as recited in claim 1 wherein the outer end shank has a bore and the at least one impact head has a impact shank having an groove and o-ring coupled thereto so that the impact shank removably slides in the bore and the o-ring forms a compression fitting to the bore.

24. A chiropractic adjusting instrument comprising:

an impact head, a housing containing an electromechanical drive mechanism having a preload activation position and coupled to the impact head, an electronic pulse system coupled to an electric power source and the electromechanical drive mechanism, and a triggering system coupled to the electromechanical drive system by a switch and to the electronic pulse system by a trigger switch;

wherein the trigger switch can not activate the electronic pulse system to energize the electromechanical drive mechanism unless the electromechanical drive mechanism is in the preload activation position to activate the switch.

25. The chiropractic adjusting instrument as recited in claim 24 further comprising a indicator coupled to the trigger system, electronic pulse system and electromechanical system to status information.

26. The chiropractic adjusting instrument as recited in claim 25 wherein the indicator provides power-on indication, preload ready indication, and error indication.

27. The chiropractic adjusting instrument as recited in claim 25 wherein the indicator is selected from the group consisting of visual indicators or sound indicators.

28. The chiropractic adjusting instrument as recited in claim 27 wherein the indicator is at least one light emitting diode.

29. The chiropractic adjusting instrument as recited in claim 28 wherein the at least one light emitting diode indicates power, appropriate preload and electronic pulse mode, and error modes using combinations selected from the group consisting of at least one color, at least one blink and combinations thereof.

30. The chiropractic adjusting instrument as recited in claim 27 wherein the indicator is sound output devices.

31. The chiropractic adjusting instrument as recited in claim 24 wherein the electrical power source is an alternating current source.

32. The chiropractic adjusting instrument as recited in claim 24 wherein the electrical power source is a battery.

* * * * *